US005186658A

United States Patent [19]

Kikuchi et al.

[11] Patent Number: 5,186,658

[45] Date of Patent: Feb. 16, 1993

[54] ELECTRICAL CONTACT

[75] Inventors: Shoji Kikuchi; Nobuaki Onoue, both of Kanagawa, Japan

[73] Assignee: AMP Incorporated, Harrisburg, Pa.

[21] Appl. No.: 689,034

[22] PCT Filed: Oct. 30, 1989

[86] PCT No.: PCT/US89/04793

§ 371 Date: May 24, 1991

§ 102(e) Date: May 24, 1991

[30] Foreign Application Priority Data

Nov. 30, 1988 [JP] Japan ..... 63-156292

[51] Int. Cl.[5] ..... H01R 13/00

[52] U.S. Cl. ..... 439/595

[58] Field of Search ..... 439/595, 748, 851, 877

[56] References Cited

U.S. PATENT DOCUMENTS 2,425,670 8/1947 Buell ..... 439/746

4,690,477 9/1987 Doutrich et al. ..... 439/595

FOREIGN PATENT DOCUMENTS 1465126 1/1969 Fed. Rep. of Germany .

3105429 10/1982 Fed. Rep. of Germany .

60-4394 2/1985 Japan .

1571544 6/1980 United Kingdom .

*Primary Examiner*—Joseph H. McGlynn

*Attorney, Agent, or Firm*—Adrian J. LaRue; Timothy J. Aberle

[57] ABSTRACT

An electrical connector comprises a dielectric housing (30) having at least one cavity (31) with a wall of the cavity having a resilient lance (34), an electrical contact (10) positioned in the cavity (31) and includes conductor and insulation-crimping sections (11, 12) at both ends of the contact for respectively crimping to a conductor (20*a*) and insulation (20*b*) of an electrical wire (20), a securing member (14) and a contact section (13) are located between the crimping sections (11, 12) at opposite sides, and an outwardly-formed projection (15) is formed in the securing member (14) for engagement with a raised portion (35) of the resilient lance (34) to retain the contact (10) in the cavity (31).

2 Claims, 3 Drawing Sheets

Fig. 1
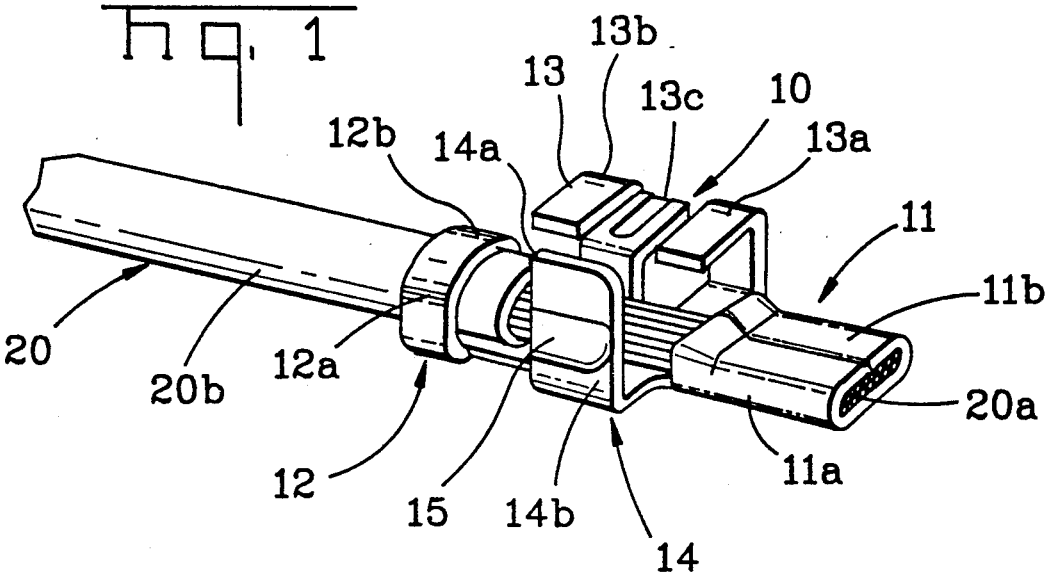
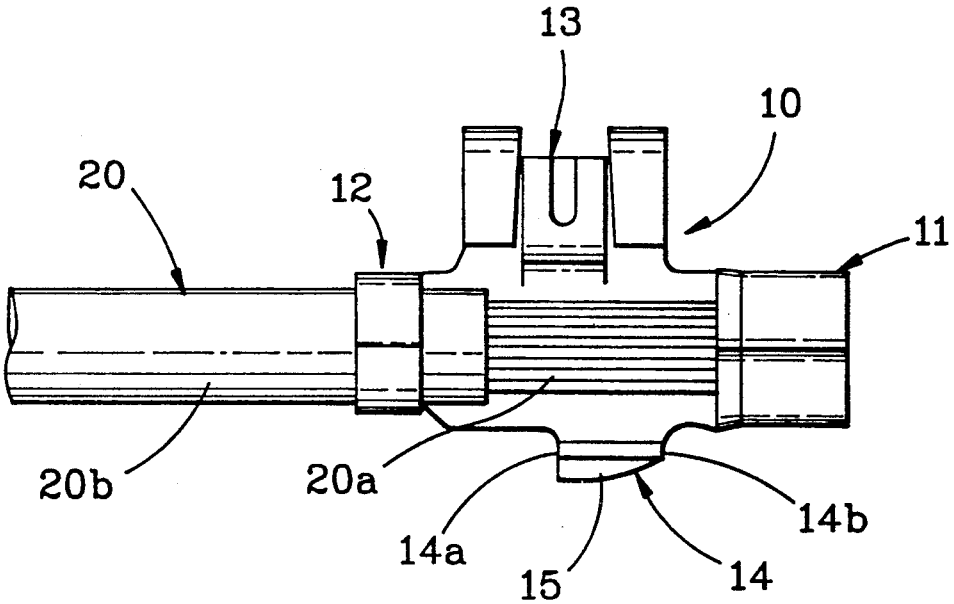
Fig. 2

ELECTRICAL CONTACT

The present invention relates to an electrical contact for an electrical connector, more specifically to one made by stamping and forming an electrically-conductive metal plate and comprising an electrical conductor-crimping section at one end and an insulation cover-crimping section at the other end.

One example of such contact is a receptacle contact having a contact section for electrical connection with a section of a mating complementary plug contact between a conductor-crimping section and an insulation cover-crimping section at one side and also an engaging member or a lance to prevent the contact from slipping out after being inserted in an insulation housing as disclosed in the specification of Japanese Utility Patent Publication No. 4394/85.

This known contact provides sufficient distance between the conductor-crimping section and the insulation cover-crimping section, thereby overcoming disadvantages associated with a shorter length, i.e., possible cutting of the conductor in the wire-crimping operation and improper electrical contact with the wire conductor. In this way, the electrical connection operation is made easier and the height of the insulation housing to hold the contact is reduced.

The conventional engaging member or lance is made by cutting and forming outwardly the side edges of the section at the side of the insulation cover-crimping section, thereby providing resiliency of the engaging member. In order to maintain the contact having such an engaging member in the insulation housing, the contact is inserted in a cavity of the insulation housing at one or upper opening end and the engaging member is pushed inwardly by the inner wall of the cavity against its resiliency. Simultaneously, a fixed step portion formed on the one side wall of the cavity releases the inward pushing so that a tip of the engaging member is engaged with the step portion, thereby providing the contact with lance means in the direction opposite to the insertion thereof.

However, the engaging member is made by forming outwardly a relatively thin metal member, and thus insufficient in strength. It may also be bent or deformed when pulled in the opposite direction with a relatively strong force, thus, it may be broken due to metal fatigue when it is frequently inserted in and extracted from the insulation housing, i.e., when the number of insertions and extractions increases. Also, since the engaging member forms a substantially V-shaped gap with the side edge of the contact, such engaging member tends to catch and scratch wires and the engaging member may be deformed, especially when handling electrical wires having a plurality of contacts connected thereto. If a shorter engaging member is used to avoid such problems, the resiliency will be ineffective for proper engagement with the fixed step portion.

It is, therefore, an object of this invention to overcome the aforementioned disadvantages of the conventional contact. For this end, an engaging member is formed by forming an outward projection in one side edge of a member between a conductor-crimping section and an insulation cover-crimping section of a contact.

A resilient lance is formed in an insulation housing for engaging such engaging member of the contact when inserted within the insulation housing.

In order to achieve the above object, the contact, according to the present invention, is made by stamping and forming an electrically conductive metal sheet and comprises a conductor-crimping section at one end, an insulation cover-crimping section at the other end, an electrical contact section with a complementary contact at one side between both crimping sections, a securing member at the other side between both crimping sections, and an engaging member to secure the contact within an insulation housing formed on the securing member.

The engaging member is formed by forming an outward projection in a part of the securing member at one side edge at the insulation cover-crimping section side of the securing member.

In the preferred embodiment of the present invention, the engaging member is formed outwardly from the opposite side edge of the securing member toward the one side edge.

The contact, as formed above, is inserted in a cavity of an insulation housing against the resiliency of a resilient lance formed as a part of a side wall of the cavity. The engaging member is pressed inwardly and then overrides one end of the housing lance until it is brought into an engaged condition therewith. In this way, the contact is secured in the reverse direction to the insertion direction thereof. The electrical contact section is electrically connected with a complementary mating contact secured in a separate insulation housing.

The contact according to the present invention will be described in detail by way of example hereunder with reference to the accompanying drawings.

FIG. 1 is a perspective view of one embodiment of the contact according to this invention crimped to an electric wire;

FIG. 2 is a top plan view of FIG. 1;

Figure 3:
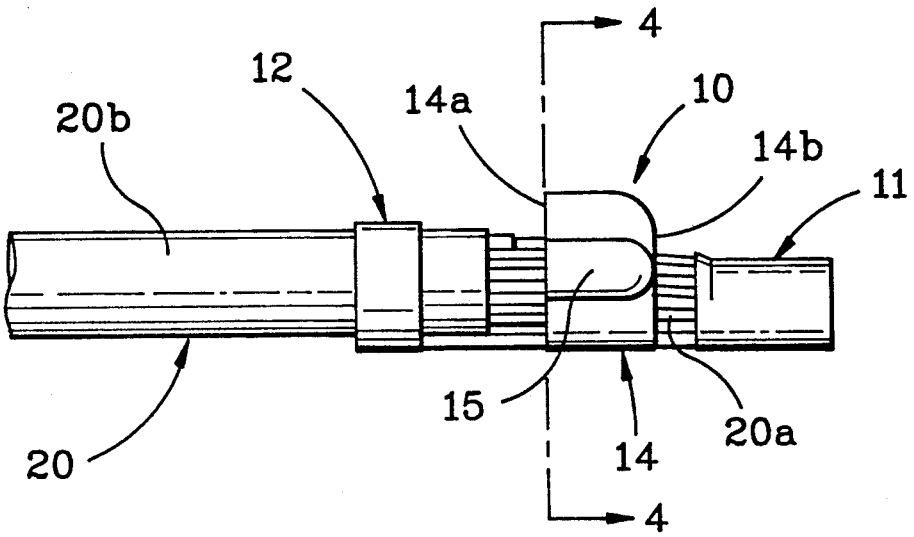
FIG. 3 is a side elevational view of FIG. 1.
Figure 4:
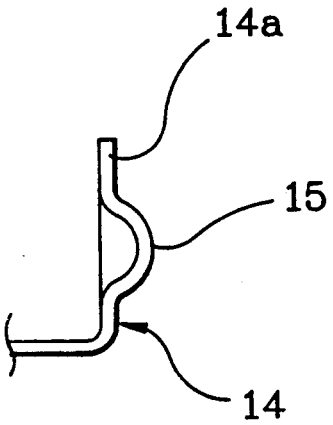
FIG. 4 is a view taken along line 4—4 of FIG. 3 showing the engaging member on the securing member.

In FIGS. 1 through 4, receptacle contact 10 is made from an electrically-conductive metal sheet by conventional stamping and forming techniques. Contact 10 formed in th is manner comprises crimping section 11 for conductor core 20*a* of electric wire 20, crimping section 12 for insulation 20*b* of wire 20, electrical receptacle contact section 13 for electrical connection with pin contact section 41 (see FIG. 6) of complementary mating contact 40 described hereinafter, and securing member 14 having engaging member 15 for engagement with insulation housing 30 (see FIGS. 5 and 6) described hereinafter.

Conductor core-crimping section 11 comprises a pair of crimping members 11*a*, 11*b* extending to both sides at one end of contact 10. Both crimping members are bent inwardly to crimp conductor core 20*a* positioned therebetween. Insulation cover-crimping section 12 comprises a pair of crimping members 12*a*, 12*b* extending to both sides at the other end of contact 10 which are crimped onto insulation cover 20*b* positioned between crimping members 12*a*, 12*b* by bending them inwardly. Contact section 13 comprises a pair of contact members 13*a*, 13*b* extending from one side between both crimping sections 11, 12 and bent upwardly and inwardly in substantially an inverted L-shape and contact member 13*c* extending from one side between both contact members 13*a*, 13*b* and bent upwardly and outwardly in an inverted L-shape. Securing member 14 extends from the other side between both crimping sections 11, 12 and is bent upwardly in substantially an inverted L-shape. Engaging member 15 is a projection and is made by deforming outwardly a portion of one side edge 14*a* of member 14 facing insulation cover-crimping section 12. As shown in FIG. 2, engaging member 15 takes a form to gradually protrude from the direction of the other side edge 14*b* toward the one side edge 14*a* of member 14 in an arcuate configuration. It is also arcuate along the one side edge 14*a* and in vertical cross section as clearly shown in FIG. 4. The engaging member 15 is therefore very large in mechanical strength and provides very smooth sliding against the inner wall surface of a cavity of the housing. Engaging member 15 is preferably arcuate as mentioned above. It may not necessarily be arcuate but may be, for example, polygonal as long as it protrudes gradually from the other side edge 14*b* to the direction of the one side edge 14*a* of member 14.

Figure 5:
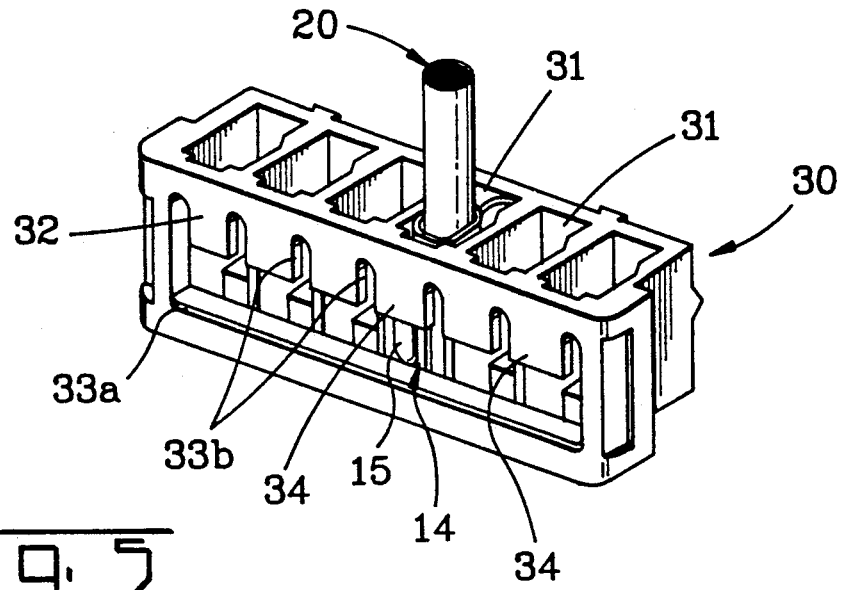
FIG. 5 is a perspective view of a connector including a dielectric housing securing the contact crimped to an electric wire shown in FIGS. 1 through 3 therein.
Figure 6:
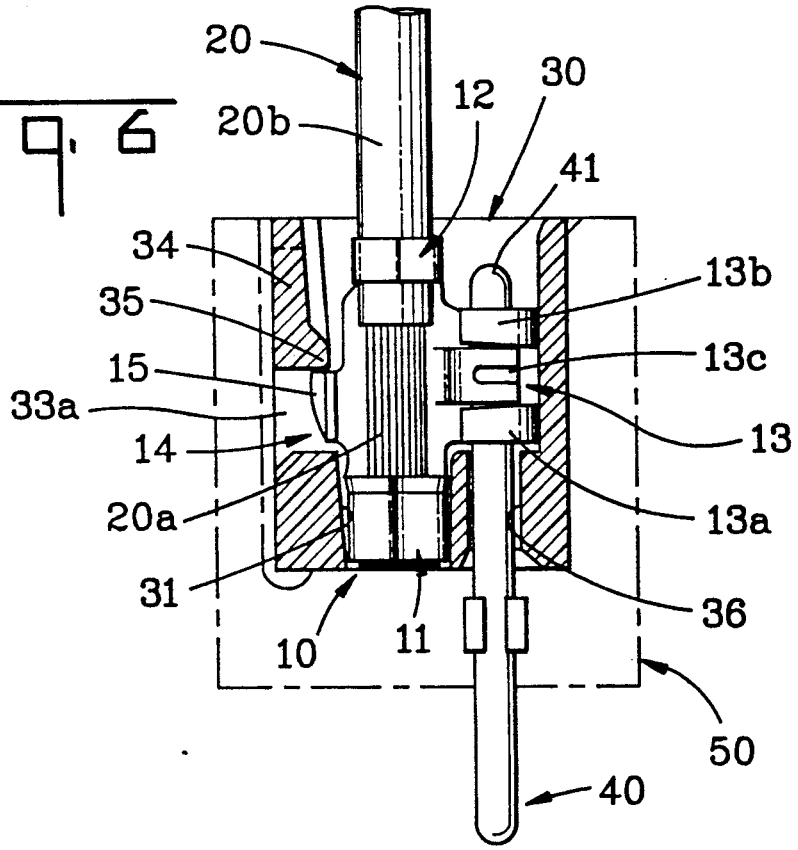
FIG. 6 is a cross-sectional view of the connector of FIG. 5 mated with another connector with the receptacle contact section of the former electrically connected with the pin contact section of the later.

Referring now toward FIGS. 5 and 6, an electrical connector is shown having contact 10 secured in insulation housing 30. Housing 30 is molded from a suitable dielectric material and has a plurality of cavities 31 and a plurality of resilient lances 34 made by forming open section 33*a* and slots 33*b* in a side wall 32, lances 34 constituting one side wall of each cavity. Each lance 34 has a progressively-increased thickness from the upper end toward the bottom of cavity 31 and has a raised portion 35 at the inner end. Housing 30 also has a cavity 36 at one side of each cavity 31.

Contact 10 is inserted into cavity 31 from the upper end of housing 30 while engaging member 15 slides along the inner surface of lance 34 against its resiliency to push the lance 34 outwardly. When engaging member 15 overrides raised portion 35, resiliency of the lance 34 allows it to return to the initial position to stop it within open section 33*a*. Therefore, the engagement between engaging member 15 and lance 34 will secure contact 10 in this position even if it is pulled upwardly. Such electrical connector having contact 10 secured in cavity 31 may be mated with another electrical connector having a complementary contact 40 secured in insulation housing 50. The mating effects electrical engagement between pin contact section 41 of contact 40 and box-shaped contact section 13 (see FIG. 1) comprising contact members 13*a*, 13*b*, 13*c* by way of cavity 36 as shown in FIG. 6.

According to the contact of an electrical connector of the present invention, an engaging member is formed as a raised section at one side edge of a member positioned between the conductor and insulation cover-crimping sections. The raised engaging member is immovable with respect to the member from which it is formed; thus, it is strong enough not to deform or break when the contact is pulled in the opposite direction to the insertion of the contact when it is secured in the cavity of the insulation housing. The contact according to the present invention solves all the problems mentioned hereinbefore associated with the conventional contact.

In addition, the engaging member of the present invention is made by simply pressing outwardly a part of the member from which it is formed from the inside to the outside thereof. No additional material is needed to form such engaging member, thereby reducing the total length of the contact and making of such contact is done more easily at a lower cost.

We claim:

1. An electrical connector comprising:

an insulation housing having at least one cavity, one wall of the housing forming the cavity including a resilient lance having an inwardly-directed raised portion adjacent an inner end;

an electrical contact including a conductor core crimping section and an insulation cover crimping section, said conductor core crimping section and said insulation cover crimping section being located at opposite ends of the electrical contact for respectively crimping to a conductor core and an insulation cover of an electrical wire, a securing member, having a side edge facing the conductor core crimping section and a side edge facing the insulation cover crimping section and having an engaging member formed therein which protrudes outwardly and tapers gradually from a maximum at the side edge facing the insulation cover crimping section to a minimum toward the side edge facing the conductor core crimping section for engagement with said raised portion when the electrical contact is inserted into the cavity to retain the electrical contact therein, and a contact section for electrical connection with a complementary mating electrical contact, said securing member and said contact section being positioned between the conductor core crimping section and the insulation cover crimping section.

2. An electrical connector comprising in combination:

an insulation housing having at least one cavity extending along the axis of insertion of a connector contact within said insulation housing, a resilient lance biased inwardly of said cavity and formed in one wall of the cavity, said resilient lance including a rounded cam surface engaged by contact insertion to drive the resilient lance outwardly in a sense transverse to said axis of insertion;

a connector contact having a body including at one end of the body a wire insulation cover gripping crimpable portion and at the other end of the body a wire conductor core crimpable portion, said body also including a matable spring contact portion extending outwardly from the side of said body between said wire insulation cover gripping crimpable portion and said wire conductor core crimpable portion to interconnect with a further contact to be mated with said connector contact, said body further including a securing member having an engaging member for engaging said resilient lance and securing the connector contact within the insulation housing, said securing member extending outwardly from said body in an opposite sense with respect to the matable spring contact portion, said engaging member being formed in a geometry of a thickness to be mechanically strong and immovable with respect to the securing member from which it is formed to preclude deformation, the engaging member further including an arcuate cam surface having an end extending outwardly relative to the axis of insertion in a position to effect a smooth sliding engagement against the rounded cam surface of said resilient lance during contact insertion in said insulation housing with the length of said resilient lance and the length of said arcuate cam surface operating to facilitate a displacement inwardly of said resilient lance relative to said axis of insertion to effect the engagement of the end of said resilient lance and the end of said arcuate cam surface of said engaging member to lock the connector contact within the insulation housing.

* * * * *